US006418827B1

(12) United States Patent
Bussey, III et al.

(10) Patent No.: US 6,418,827 B1
(45) Date of Patent: Jul. 16, 2002

(54) PERFORATING MACHINE

(76) Inventors: Harry Bussey, III, 517 Locust Pt. Rd., Locust, NJ (US) 07760; Harry Bussey, Jr., 440 Sea View Ct., Marco Island, FL (US) 33937

( * ) Notice: Subject to any disclaimer, the term of this patent is extended or adjusted under 35 U.S.C. 154(b) by 0 days.

(21) Appl. No.: 08/826,741

(22) Filed: Apr. 7, 1997

Related U.S. Application Data

(63) Continuation-in-part of application No. 08/227,250, filed on Apr. 13, 1994, now abandoned.

(51) Int. Cl.[7] ..... B26D 1/56

(52) U.S. Cl. ..... 83/304; 83/337; 83/659; 83/678

(58) Field of Search ..... 83/304, 305, 306, 83/659, 660, 678, 695, 37, 332, 333, 334, 337, 348, 347, 307

(56) References Cited

U.S. PATENT DOCUMENTS 2,345,072 A * 3/1944 Rosenleaf et al. ..... 83/306
3,244,863 A * 4/1966 Paterson ..... 83/76
3,762,157 A * 10/1973 Kitai et al. ..... 58/125 C
4,058,041 A * 11/1977 Ito ..... 83/305
4,190,777 A * 2/1980 Luce et al. ..... 307/139
4,453,436 A * 6/1984 Tokuno ..... 83/76
4,667,552 A * 5/1987 Calligarich ..... 83/171
4,779,502 A * 10/1988 Hebert ..... 83/639.1 X
4,835,558 A * 5/1989 Araki et al. ..... 354/156
4,854,201 A * 8/1989 Shinozawa ..... 83/639.1 X
5,036,588 A * 8/1991 Cherry ..... 83/639.1 X
5,114,394 A * 5/1992 Madsen ..... 83/639.1 X
5,152,205 A * 10/1992 Yoshida et al. ..... 83/304
5,207,138 A * 5/1993 Sato et al. ..... 83/305
5,265,506 A * 11/1993 Aihara et al. ..... 83/16
5,297,461 A * 3/1994 Hirakawa et al. ..... 83/304
5,325,755 A * 7/1994 Morita ..... 83/639.1 X
5,359,916 A * 11/1994 Bonnet ..... 83/639.1 X
5,372,494 A * 12/1994 Vaughan ..... 425/196
5,492,041 A * 2/1996 Valkanov ..... 83/639.1 X
5,657,677 A * 8/1997 Cuir et al. ..... 83/74

* cited by examiner

*Primary Examiner*—Allan N. Shoap
*Assistant Examiner*—Stephen Choi
(74) *Attorney, Agent, or Firm*—Francis C. Hand; Carella Byrne Bain eta

(57) ABSTRACT

The perforating machine is provided with a perforating roll having a perforating bar and a base roll below the perforating roll which can be moved between a raised position and a retracted position. In the raised position, the base roll allows the perforating bar to perforate a web passing between the two rolls. In the retracted position, the base roll lowers the web away from the perforator roll so that a perforation is not effected. A programmer is also provided to program the motion of the base roll so as to adjust the centerline to centerline spacing of the lines of perforations in the web. The perforator roll is also driven by a transmission employing elliptical gears so that the perforator roll is accelerated prior to perforating the web and decelerated thereafter. The machine may also be used to cut the web into a series of panels rather than simply perforating the web.

41 Claims, 7 Drawing Sheets

51
52
15
45
53
52'
53'

FIG. 13
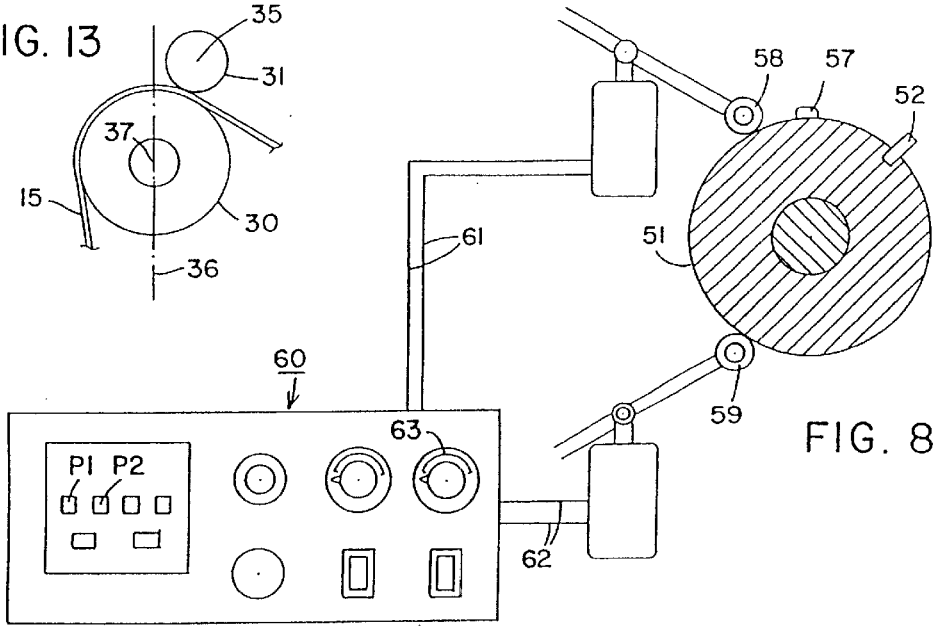
FIG. 8
FIG. 9
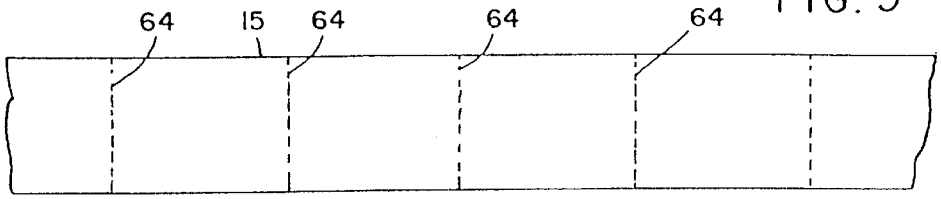
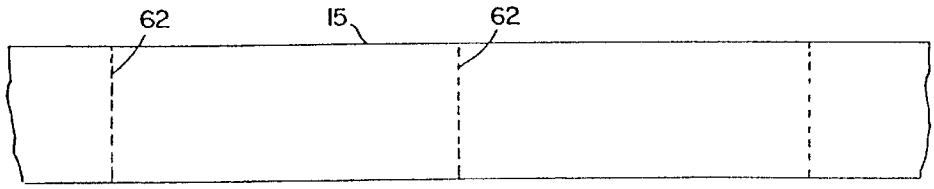
FIG. 10
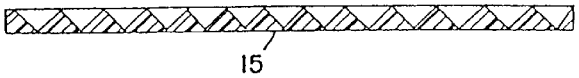
FIG. 11
FIG. 12
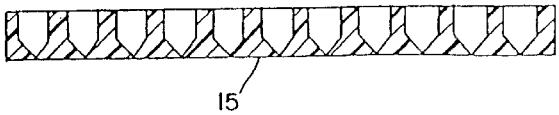

PERFORATING MACHINE

This is a continuation-in-part application of application Ser. No. 08/227,250 filed Apr. 13, 1994, now abandoned.

This invention relates to a perforating machine. More particularly, this invention relates to a machine for perforating a continuous web of material at variable points. Still more particularly, this invention relates to a machine capable of perforating or cutting a moving web of material at predetermined points.

As is known, various machines have been provided for the perforating of continuous webs of foam material. For example, machines have been known in which a web of foam material is conveyed through a perforating station in which a rotating roll having a perforating bar thereon is caused to impart a transverse line of perforations in the web on each cycle of the roll. Generally, the perforating roll is combined with a guide roll to form a nip through which the web material is conveyed and against which the perforating bar may react in order to perform a perforating operation. One of the problems which arises with such a machine occurs when the foam material is relatively thin as any differential in speed between the speed of the perforating bar and the speed of the web may cause a tearing of the web during the time of contact between the perforating bar and the web. Thus, in such cases, the speed of the perforating roll and guide roll must be matched to the speed of the web. Another disadvantage is that it is very difficult to change the center line to center line distance between successive lines of perforations should a need arise to change the length of the "panel" formed between pairs of successive lines of perforations. Generally, attempts are made to change the speed of the perforating roll or to change the speed of the web in order to vary the longitudinal distance between transverse lines of perforations in the web. However, this increases the risk that a web may be torn during the perforating operation due to a difference in speed between the perforating roll and the web.

Other machines have also been known which are of the start/stop type. However, such machines are subject to continuous wear because of the start/stop operation and take longer to make perforations.

Accordingly, it is an object of the invention to provide a machine capable of perforating a moving web of material on the fly without tearing of the web.

It is another object of the-invention to provide a machine in which a web of material moving at a constant speed can be perforated in a variable manner.

It is another object of the invention to provide a perforating machine for a web of material which can be adjusted during operation.

It is another object of the invention to provide a machine which is capable of perforating webs of material of relatively thin thickness.

It is another object of the invention to provide a machine which is capable of perforating, slitting and/or sheeting a traveling web of foam or plastic material in a continuous operation.

It is another object of the invention to be able to cut a traveling web of foam or plastic material into one or more streams of small panels of accurate size.

Briefly, the invention provides a perforating machine which includes a supply station for receiving web of material, conveying means for conveying the web of material from the supply station, a perforating station for perforating the conveyed web at spaced apart distances to define parallel spaced apart lines of weakening in the web for subsequent separation of the web into separate sheets and a receiving station for receiving the perforated web of material from the perforating station.

In one embodiment of the invention, the perforating station includes a base roll for supporting the conveyed web during passage through the perforating station and means for selectively moving the base roll between a retracted position and a raised position. The perforating station also includes a perforator roll opposite the base roll for imparting at least a transversely disposed line of perforations in the web passing between the rolls with the base roll in the raised position.

Basically, the machine is constructed in this embodiment to perforate a moving web of material, such as a plastic foam web, a plastic bubble web of single or multi-ply construction, and the like, with spaced apart lines of perforations and is constructed so that the spacing of the lines of perforations can be varied when desired.

During use, the conveying means conveys the web between the two rolls of the perforating station. In this regard, the perforator roll carries a perforating bar of suitable construction for perforating the web of material on the fly. During operation, the perforating roller remains on a fixed axis while rotating. The opposed base roll, on the other hand, is disposed in spaced relation below the perforating roller in a retracted position. When a perforation is to take place, the base roll is moved upwardly into the raised position. After a perforation has occurred, the base roll is returned to the retracted position. In this regard, the machine is further provided with a timing means for adjustably timing the actuation of the means for moving the lower base roll into the raised position so that a perforation can be effected in the moving web.

The timing means may employ a cam mounted on the perforator roll in a position indicative of the position of the perforating bar for rotation with the perforating roll. In addition, a first switch is mounted in a fixed position in the perforating station for emitting a signal during passage of the cam thereby while a second switch is mounted in a further fixed position in the perforating station for emitting a second signal during passage of the cam thereby. In addition, a programmer is provided for receiving the signals from the two switches for actuating the means for moving the lower roll in response to a predetermined sequence of the signals. For example, when the cam passes by the first switch, a signal is emitted to indicate the position of the perforating bar on the perforating roll. When the second limit switch is activated, a second signal is emitted so as to cause lifting of the lower roll into the raised position. As the perforating roll continues to rotate, the perforating bar forms a perforation in the moving web. As the perforating roll makes a second revolution, the first switch emits a further signal (i.e. a third signal) indicating that a perforation has been made. Activation of the second switch causes a further signal (i.e. a fourth signal) to be emitted to cause the lower roller to be retracted into the retracted position so that no perforation can occur. This sequence of signals can then be repeated such that a perforation is made for every two revolutions of the perforating roll.

By adjusting the sequence of signals, the spacing between successive lines of perforations can be varied in a multiple or fractional relationship. For example, if the above exemplified sequence of four signals produces perforations on a twelve inch spacing, a sequence of only two of the signals would produce a spacing of six inches whereas a sequence of six signals would provide spacings of eighteen inches.

The machine is also provided with a transmission for rotating the perforator roll in a cycle having an acceleration phase which occurs during the perforation of the web and a deceleration phase which occurs after perforation of the web. In this way, the speed of the perforating bar can be adjusted to match the conveying speed of the web in order to avoid tearing of the web. Thus, the rotational speed of the perforating roll can be quite different from the conveying speed of the web since the perforating roll can be accelerated to a suitable speed to match with the speed of the web at the time of perforation.

In order to handle foam materials in a gentle manner, the lower base roll of the perforating station is made with a relatively soft surface. For example, the roll may be in the form of a brush roll having a plurality of upstanding filaments for supporting the conveyed web of material. In addition, the brush roll may be rotated by suitable means during conveyance of the web, particularly in the case of relatively thin foam materials.

The machine is particularly suitable for perforating foam webs having thicknesses of from 1/32 to 1/4 inches.

The machine may also be provided with at least one slitter upstream of the perforator roll for impressing a longitudinal line of weakening in the conveyed web. In this way, the web may be separated into two or more sections. Additional slitters may also be provided for trimming the edges of the web or for effecting additional longitudinal lines of weakening to form multiple rolls of perforated web or multiple panels.

The perforating roll may also be provided with a bar which effects a complete severance of the web rather than simply effecting a line of perforations in the web. In this embodiment, successive panels can be cut from the traveling web in a "sheeting" manner. The resulting panels can then be stacked in a suitable manner in the receiving station.

These and other objects and advantages of the invention will become more apparent from the following detailed description taken in conjunction with the accompanying drawings wherein:

FIG. 8 illustrates a schematic view of a timing means in accordance with the invention relative to the perforating roll;

FIG. 9 illustrates a plan view of a web perforated in accordance with the invention;

FIG. 10 illustrates a plan view of a web having a different spacing of perforations in accordance with the invention;

FIG. 11 illustrates a cross-sectional view of a line of perforations in a conveyed web configured by the bar of FIG. 6 in accordance with the invention;

FIG. 12 illustrates a cross-sectional view of a modified line of perforations configured by the bar of FIG. 7 in accordance with the invention;

FIG. 13 illustrates a cross-sectional view of a guide roll arrangement of the conveying means for feeding the web to the perforating station in accordance with the invention;

Figure 1:
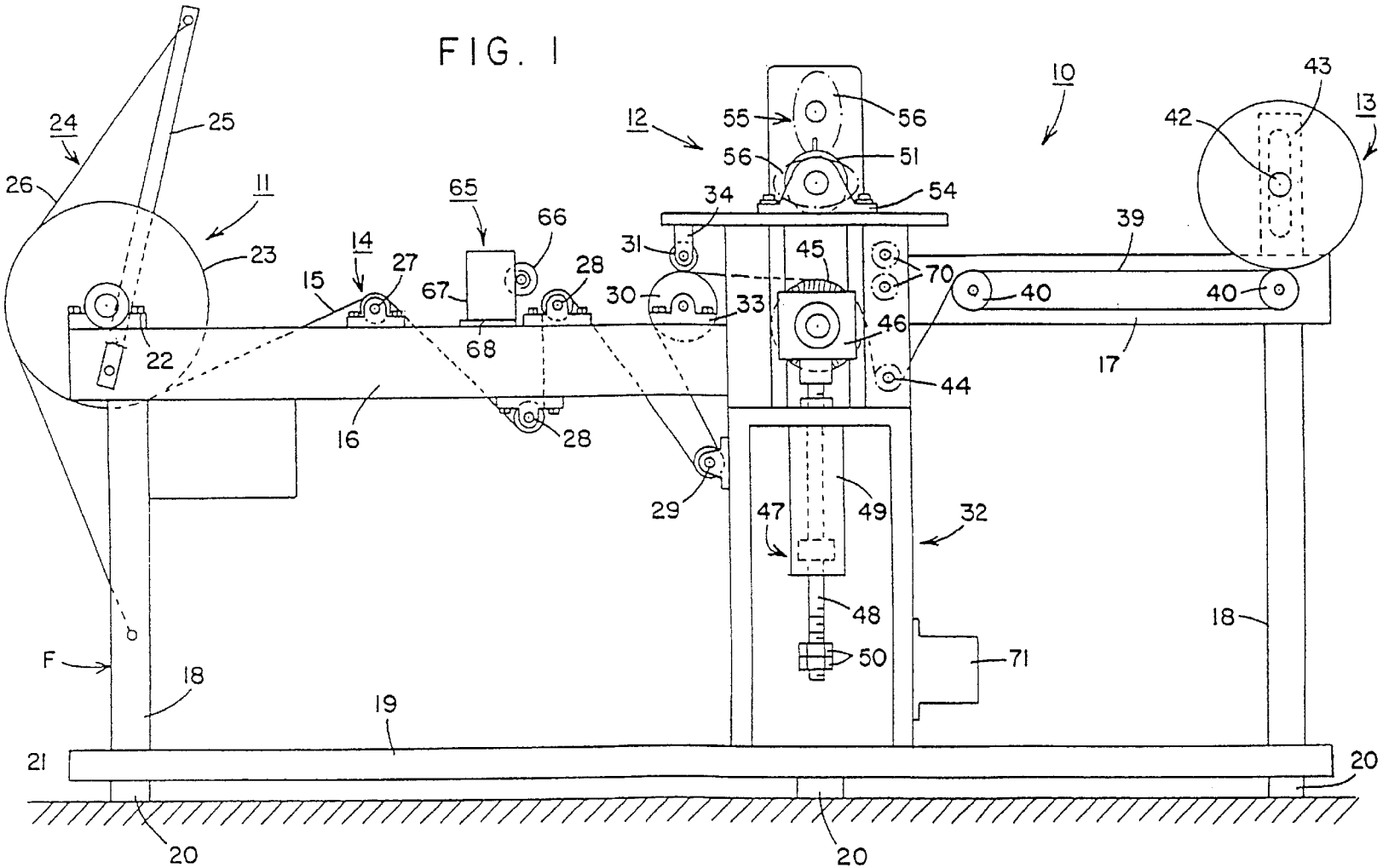
FIG. 1 illustrates a side view of a machine constructed in accordance with the invention for use as a perforating machine.

Referring to FIG. 1, the perforating machine 10 includes a supply station 11, a perforating station 12, a receiving station 13 and conveying means 14 for conveying a web of material 15 from the supply station 11 through the perforating station 12 to the receiving station 13.

Figure 2:
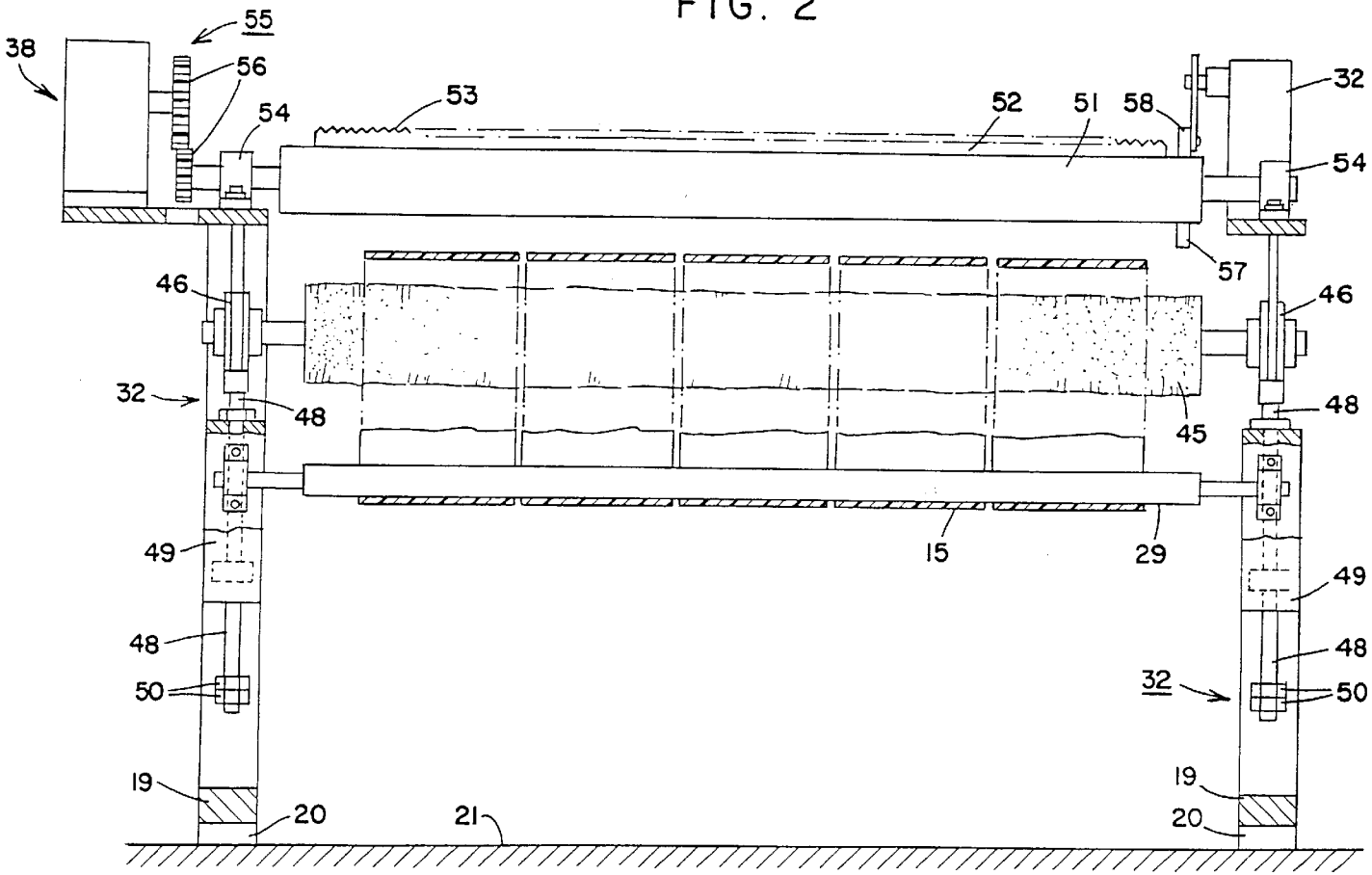
FIG. 2 illustrates a cross-sectional view taken on line 2—2 of FIG. 1.

The machine 10 includes a frame F of skeletal-like structure for mounting of the respective stations 11, 12, 13 thereon. As indicated in FIGS. 1 and 2, the frame F has pairs of parallel horizontal beams 16, 17 which are supported in an elevated position by various vertically disposed legs 18 on a pair of support rails 19. As indicated, the support rails 19 are mounted in a slightly elevated fashion by support feet 20 on a floor or other suitable base 21.

The supply station 11 includes a pair of saddles 22 or the like mounted on the respective beams 16 in order to rotatably receive a supply roll 23 from which the web of material 15 can be unwound. In addition, the supply station 11 is provided with a weighted arrangement 24 to brake the feed of the web 15 from the supply spool 23 so as to maintain a tension in the traveling web 15. This arrangement 24 includes a V-shaped frame 25 which is pivotally mounted on the frame F and which carries a drape 26 of cloth or the like which descends over the spool 23 and which can be fixed to the vertical legs 18 or which may carry a weight at the lower end to depend under gravity.

The conveying means 14 includes a series of guide shafts 27, 28, 28', 29 over which the web 15 is guided to the perforating station 12. These guide rollers 27, 28, 28', 29 are mounted in suitable bearings fixed to the frame F of the machine 10, as indicated. The conveying means 14 also includes a feed roller 30 and a hold-down roller 31 over the feed roller 30 for driving the web 15 to the perforating station 12. As indicated, the web 15 passes over the guide shafts 27, 28, 28', 29 for delivery between the feed roller 30 and hold-down roller 31. Thereafter, the web 15 passes into the perforating station 12.

The perforating station 12 includes a skeletal frame 32 on each side of the machine 10 which is mounted on the support beams 19 and which rises vertically between the horizontal beams 16, 17, as indicated in FIG. 1. At the upper end, each frame 32 carries bearings 33, 34 in which the feed roller 30 and hold-down roller 31 are journaled for rotation.

The conveying means 14 also includes a suitable transmission 38 (see FIG. 2) for driving the feed roller 30.

The receiving station 13 includes a conveyor in the form of a conveyor belt 39 which extends horizontally from the perforating station 12 to receive the perforated web 15. This conveyor belt 39 extends across the machine 10 and is disposed about a pair of rollers 40 at least one of which is driven by a suitable motor (not shown) so that the surface speed of the belt 39 is at least equal to the speed of the web 15. As indicated in FIG. 1, the horizontal plane of the upper run of the conveyor belt 39 is substantially in the same plane as the top of the feed roller 30.

The receiving station 13 also includes a wind-up spool 42 which is freely mounted in vertical guides 43 for winding up of the web 15 thereon. As indicated, the wind-up spool 42 is mounted over one end of the conveyor belt 39 to rest thereon prior to winding of a web 15 thereon. Thus, the weight of the wind-up spool 42 and the subsequently wound web thereon maintains sufficient frictional contact between the web on the spool 42 and the conveyor belt 39 so that the spool 42 continues to rotate and wind-up the web 15.

A higher speed in the conveyor belt 39 relative to the speed of the web 15 exiting from the perforating station 12 helps to wind the web 15 tighter on the spool 42. As the spool 42 winds on the perforated web 15, the ends of the spool 42 ride up in the vertical guides 43 e.g. via suitable slots in the guides 43.

The conveying means 14 also has a guide roller 44 mounted in the machine frame F for guiding the web 15 from the perforating station 12 to the conveyor belt 39 of the receiving station 13.

Referring to FIGS. 1 and 2, the perforating station 12 also has a base roll, such as a brush roll 45, mounted in suitable bearings 46 on each side of the machine 10. As indicated in FIG. 1, each bearing 46 is slidably mounted within the frame 32 for vertical motion. A means 47 is also provided in each frame 32 for selectively moving the brush roll 45 between a retracted position (as shown in FIG. 1) conveying the web 15 passing through the perforating station 12 and a raised position. Each means 47 includes a piston/cylinder arrangement in each frame 32 for reciprocating the bearing 46 vertically. The arrangement includes a piston 48 which is secured at an upper end to the bearing 46 and a cylinder 49 which is fixedly mounted to the frame 32. The cylinder 49 may be of the pneumatic type for reciprocating the piston 48 therein. Thus, upon pressurization of the cylinder 49, the piston 48 is caused to move upwardly thereby moving the bearing 46 in which the respective end of the brush roll 45 is journaled upwardly. As indicated, the lower end of the piston 48 is threaded and carries a pair of lock nuts 50. A collar or shim (not shown) may also be disposed on the piston 48 between the lock nuts 50 and the cylinder 49 so as to provide for an adjustment of the amount of lift of the brush roll 45.

The brush roll 45 may be formed of a plurality of upstanding filaments so as to provide a suitable surface for gently supporting the travelling web 15 and for rotating therewith.

Figures 3, 4, 5, 6, 7:
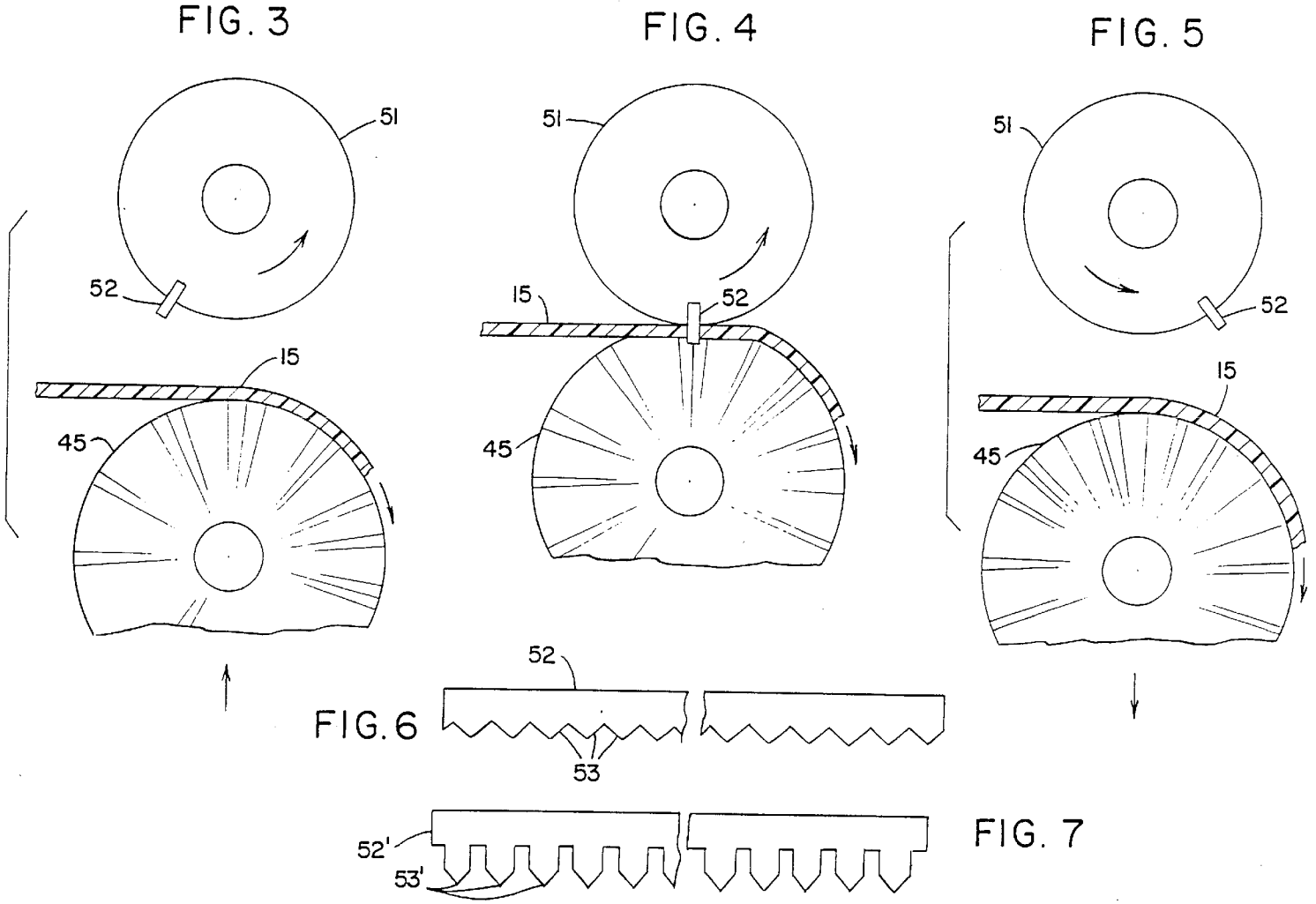
FIG. 3 illustrates a partial cross-sectional view of the rolls of the perforating station prior to perforating a conveyed web.
FIG. 4 illustrates a view similar to FIG. 3 of the rolls during a perforating step.
FIG. 5 illustrates a view similar to FIGS. 3 and 4 after a perforation has been made.
FIG. 6 illustrates a view of a perforating bar for effecting a line of perforations.
FIG. 7 illustrates a view of a perforating bar for effecting a modified line of perforations.

The perforating station 12 also includes a perforator roll 51 opposite the brush roll 45 for imparting at least a transversely disposed line of perforations in the web 15 passing between the rolls 45, 51 with the brush roll 45 in the raised position. As indicated in FIG. 2, the perforator roll 51 is mounted in suitable bearings 54 mounted on the frame 32 and carries a longitudinally extending perforating bar 52 for perforating the web 15. As indicated in FIG. 6, the perforating bar 52 is provided with a plurality of serrated teeth 53 of triangular shape to form a line of triangular perforations in the web 15 as shown in FIG. 11. Alternatively, as indicated in FIG. 7, the perforating bar 52' may be provided with a plurality of spaced apart elongated teeth 53' each of which has a triangular apex so as to form a perforation as illustrated in FIG. 12 in the web 15.

The perforating bar 52' may also be used for perforating two or more layers of webs which are conveyed through the perforating station 12. In such an embodiment, each web may be wound up on a separate wind-up spool (not shown) located at different points near the far end of the conveyor belt 39. In this respect, the conveyor belt 39 would be of longer extent than as shown in FIG. 1 and a second wind-up spool arrangement would be provided for winding up the second web. Additional wind-up spools may be provided for additional webs which have been perforated in a multi-web configuration.

The perforator roll 51 is driven from the transmission 38 so as to rotate at a programmed speed. In addition, a supplementary transmission 55 is disposed between the main transmission 38 and the perforator roll 51 so as to rotate the perforator roll 51 in a cycle having a deceleration phase prior to perforation of the web 15 and an acceleration phase after perforation of the web 15. As indicated, this supplementary transmission 55 includes a pair of elliptical gears 56 which are arranged in a cross-wise meshing relationship such that when the upper gear 56 has a major axis disposed in a vertical plane, the lower gear 56 has a major axis disposed in a horizontal plane. Such a supplementary transmission is of known construction and need not be further described.

The deceleration of the perforator roll 51 prior to perforating the web 15 serves to bring the surface speed of the bar 52 to the speed of the web 15 to avoid a differential in speeds which might otherwise lead to tearing of the web 15.

Referring to FIGS. 2 and 8, the machine is provided with a timing means for adjustably timing actuation of the means 47 for moving the brush roll 45 into the raised position. For example, the timing means includes a cam 57 which is fixedly mounted on the perforator roll 51 for rotation therewith. The cam 57 is located in a position which is indicative of the position of the perforating bar 52 and thus represents a known position of the perforating bar 52 at any time. The timing means also includes a pair of switches 58, 59 which are mounted on the frame 32 in fixed positions relative to the perforator roll 51. Each switch 58, 59 is constructed to emit a signal in response to passage of the cam 57 thereby during rotation of the perforator roll 51. In addition, the timing means includes a programmer 60 which is connected to each switch 58, 59 via suitable lines 61, 62, respectively (see FIG. 8). This programmer 60 receives the signals from the respective switches 58, 59 and actuates the piston/cylinder arrangements 47 for moving the brush roll 45 in response to a predetermined sequence of signals.

The programmer 60 may be embodied within a housing mounted on or to the side of the machine frame F and is provided with various controls and displays which can be manually programmed to run the machine. By way of example as indicated in FIG. 8, one switch 58 may be located in an eleven o'clock position while the second switch 59 is located in a seven o'clock position. The first switch 58 emits a signal to the programmer 60 to indicate that the perforating bar 52 is in a predetermined position on the perforator roll 51. When the second limit switch 59 is activated, a signal is emitted to the programmer 60 to effect raising of the brush roll 45 (see FIG. 3). As the perforator roll 51 continues to rotate (counter-clockwise as viewed in FIG. 3), the perforating bar 52 moves into the moving web 15 and effects a transverse line of perforations (see FIG. 4). As the perforator roll 51 continues to rotate, the web 15 continues to move with the brush roll 45 also rotating. In this respect, the brush roll 45 may also be positively driven from the transmission by suitable means (not shown), particularly where the web 15 is of relatively thin material.

When the cam 57 on the perforator roll 51 again moves past the upper switch 58, a third signal is sent to the programmer 60 to indicate that a perforation has been made. Subsequent activation of the lower limit switch 59 by the cam 57 causes a further signal (fourth signal) to be emitted to the programmer 60 to cause the brush roller 45 to be lowered via the piston/cylinder arrangements 47 (see FIG. 5). At this time, the web 15 moves away from the path of the perforating bar 52 and roll 51 so that no line of perforation can be made.

After being perforated, the web 15 passes under the guide roller 44 and travels over and across the conveyor belt 39 to be wound up on the spool 42 in the receiving station 13 as indicated in FIG. 1. The guide roller 44 is positioned in the frame 32 to maintain the web 15 in contact with the brush roll 45. This enhances the consistency of the perforating operation and avoids breaks in the web 15 where the lines of perforations are made.

Referring to FIG. 8, the programmer 60 may be provided with four push buttons. One button P1 is used to program the machine relative to the limit switches 58, 59 while a second button P2 is used to further program the machine relative to the limit switches 58, 59. For example, manually pushing button P1 to a setting of "2" means that after the cam 57 on the perforator roll 51 has passed by the two limit switches 58, 59, the brush roll 45 is moved upwardly. Setting the second button P2 to a number such as "4" instructs the machine 10 to move the brush roll 45 downwardly, i.e. after the two limit switches 58, 59 have again been passed by. If button P2 is set to infinity, then the brush roll 45 remains in the raised position and perforations are effected on equal spacings, for example, on 12 inch spacings.

If one wishes to change the spacing of the lines of perforation, button PI would be pressed to change the number to a setting of, for example, "4" while button P2 is changed to "6". In effect, this would double the spacing of the perforations to 24 inches. That is, the brush roll 45 would move up after four counts (i.e. signals) and would move down after six counts of course, any other sequence can be used to provide for the spacing of the lines of perforations.

The programmer 60 is also provided with other controls such as-a speed control 63 to vary the speed of the machine via the main transmission and a control to vary the speed of the motor driving the conveyor 39.

As indicated in FIG. 9, for the first indicated sequence of signals ("2" and "4"), lines of perforations 64 can be spaced apart at 12 inch intervals. By changing the setting to "4" and "6" the lines of perforation 64 would be spaced apart at twice the amount i.e. at 24 inch intervals as graphically indicated in FIG. 10.

Referring to FIG. 1, the machine may also be provided with at least one slitter 65 upstream of the perforator roll 51 for impressing a longitudinal line of weakening in the conveyed web 15. As indicated, the slitter 65 may be in the form of a disc 66 which is rotatably mounted in a housing 67 which is mounted on a horizontal plate 68 extending across the machine frame F. In addition, the slitter disc 66 is biased against the guide roller 28' which thus acts as a back-up surface in order to form the line of weakening in the web 15. Additional slitters may also be provided in order to trim the edges of the web 15 and/or to form additional lines of weakening in the web 15 to form parallel streams in the web 15 which can be readily separated when desired.

The slitter 65 may be of the pneumatic type wherein a supply of compressed air is delivered to the housing 67 so as to actuate a piston not shown) therein for biasing the disc 66 against the guide roller 28'. Such a slitter 65 is of generally known construction and need not be further described.

Figure 14:
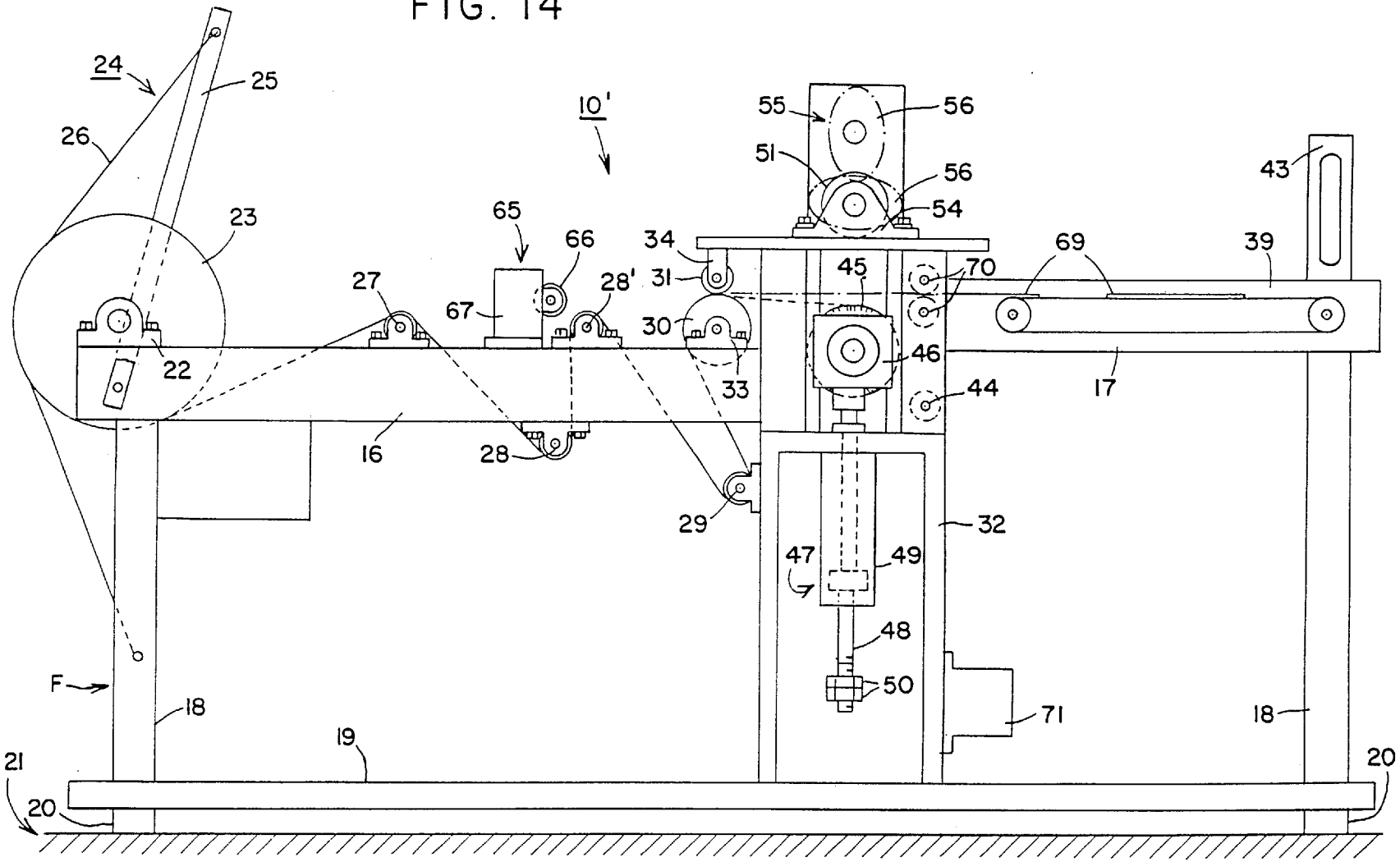
FIG. 14 illustrates a view of the machine of FIG. 1 configured for a sheeting operation in accordance with the invention.

Referring to FIG. 14, wherein like reference characters indicate like parts as above, the machine 10' may be modified to carry out a sheeting operation, that is, an operation in which a series of panels 69 are cut from the travelling web 15. To this end, a pair of rotatably driven rolls 70 is mounted in the frame 32 downstream of the brush roller 45 and perforator roll 51 for passage of a series of panels 69 cut from the web 15 therethrough. Each roll 70 has a soft deformable surface for engaging a respective side of a cut panel 69. In this respect, the softness of the rolls 70 relative to a panel 69 is such that the panel 69 can be gently gripped and conveyed through a gap between the two rolls 70. In addition, the two rolls 70 are mounted in an adjustable manner within the frame 32 so that the gap between the two rolls 70 can be adjusted in dependence on the thickness of the panels 69 passing therethrough. In addition, the upper roll 70 is made of a larger diameter than the lower roll 70. For example, the upper roller may be a 3 inch diameter roller while the lower roll 70 is a 2.5 inch diameter roller.

A means in the form of a motor 71 is mounted on the frame 32 in a suitable position for driving the rolls 70 at a surface speed greater than the surface speed of the brush roll 45 in order to effect a small spacing between successive panels 69 cut from the web 15. This motor 71 may be controlled via a control knob in the programmer 60.

Figure 16:
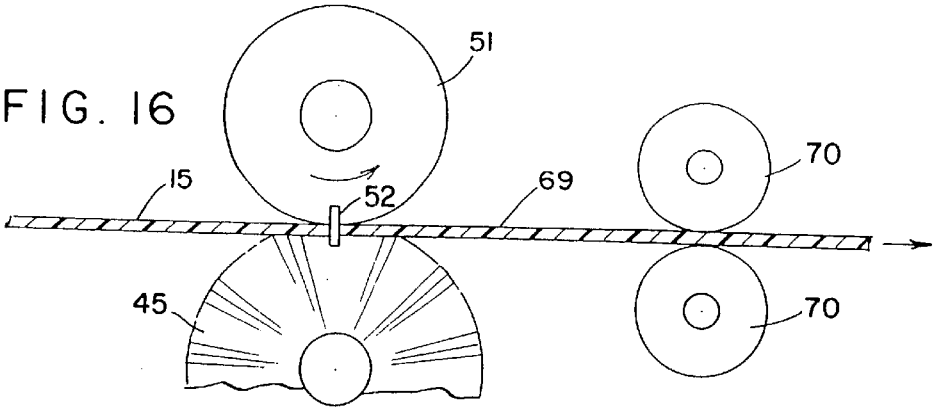
FIG. 16 illustrates a view similar to FIG. 15 of the rolls during a sheeting step.

As illustrated in FIG. 14, the gap between the two rolls 70 is located substantially in the same horizontal plane as the top surface of the feed roll 30. In addition, the lower roll of the pair of rolls 70 contacts the brush roller 45 when the brush roller 45 is in the raised position as indicated in FIG. 16. The contact between this roll 70 and the brush roller 45 is such that the soft deformable surface of the roll 70 may clean the brush roller 45.

As indicated in FIG. 14, the web 15 is passed over the guide rollers 27, 28, 28', 29 and fed between the feed roller 30 and hold-down roller 31 for delivery into the perforating station 12, that is, between the brush roller 45 and the perforator roll 51. In this regard, as illustrated in FIG. 13, the feed roller 30 and hold-down roller 31 define a nip for passage of the web 15 therebetween. In addition, the hold-down roller 31 is disposed on an axis 35 spaced horizontally from a vertical plane 36 passing through the axis 37 of the feed roller 30 and in a direction towards the perforating station 12 in order to direct the web 15 downwardly into the perforating station 12.

Figure 15:
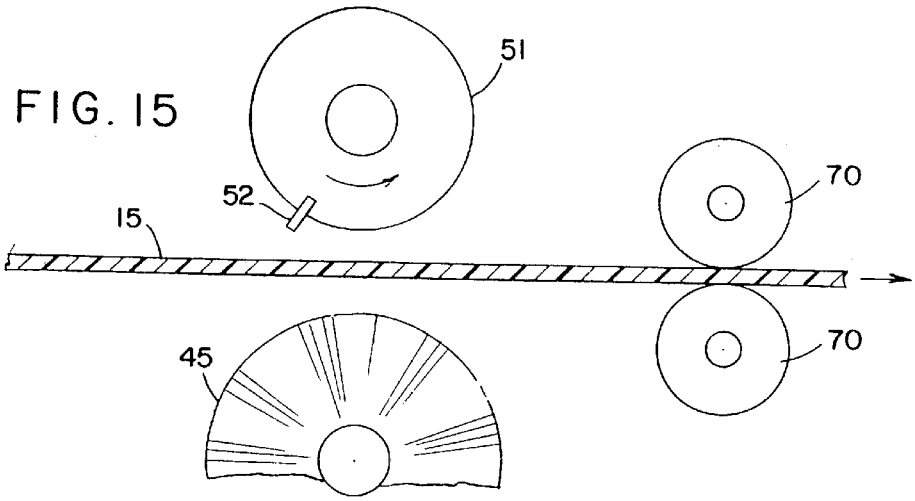
FIG. 15 illustrates a partial cross-sectional view of the rolls of the perforating station prior to cutting a conveyed web into panels.

Upon passage of the web 15 between the brush roll 45 and the perforator roller 51, the web 15 is spaced from each and extends forwardly between the soft-surfaced rolls 70 as shown in FIG. 15. When the brush roll 45 is raised from the retracted position shown in FIG. 15 to the raised position shown in FIG. 16, in a manner as described above with respect to FIG. 1, the perforator bar 52 which is suitably constructed effects a longitudinal cut in the travelling web 15 so that a panel 69 is separated from the web 15. As indicated in FIG. 14, the panel 69 passes between the rolls 70 onto the conveyor belt 39 of the receiving station 13. The panel 69 can then be conveyed into a suitable stacker (not shown) so that a sequence of panels 69 can be stacked in vertical manner and subsequently transported from the machine 10'.

In using the machine 10 of FIG. 1 in a sheeting operation, use is not made of the guide roller 44.

Figure 17:
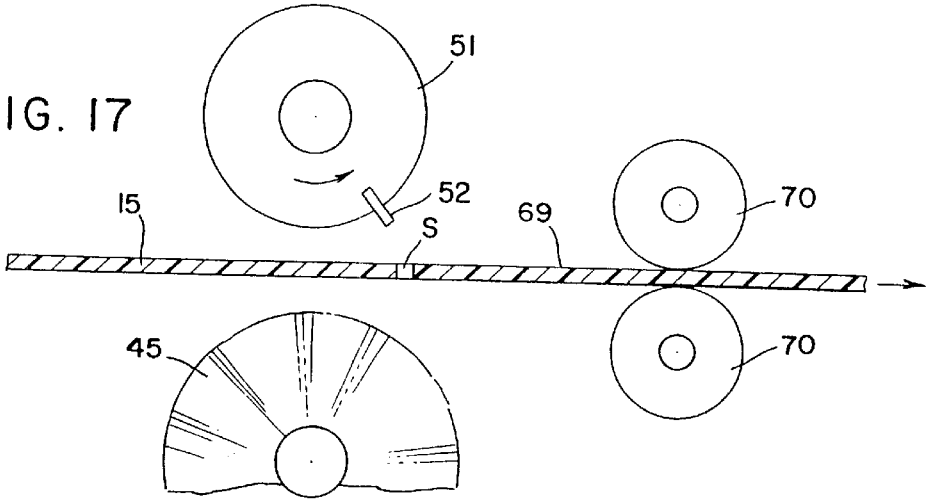
FIG. 17 illustrates a view similar to FIGS. 3 and 4 after cutting of a panel from the web in accordance with the invention.

When a panel 69 is severed from the web 15, the perforator roll 51 is in the acceleration phase so that the panel 69 is pushed forward slightly through the gap between the rolls 70 while being spaced from the now leading end of the web 15 as shown in FIG. 17. In addition, the rolls 70 are driven at a slightly faster surface speed than the speed of the brush roller 45 so that the overall affect on the panels 69 is to eject the panels 69 onto the conveyor belt 39 ahead of the front edge of the trailing web 15. In this way, a spacing S can be effected between successive panels 69.

The machine 10' may be programmed to provide panels 69 of various lengths. For example, panels as small as four inches in length or as long as thirty-six inches or more in length may be produced depending upon the length of the receiving station 13. Likewise, one or more slitters 65 may be provided so that the panels 69 are of various widths, for example, the widths may be as small as four inches or less.

In the event that a need arises to change the length or width of a panel during operation, the programmer 60 may be adjusted to effect panels of greater or lesser length. Likewise, one or more slitters 65 may be employed to change the width of the panel. A change over from one size to another may be accomplished in a manner of a few minutes and usually in less than 15 minutes.

Of note, the soft-surface rolls 70 are allowed to slip relative to a panel 69 being conveyed therethrough. That is to say, the rolls 70 do not frictional grip the panels 69 so as to move the panels 69 forwardly.

In an alternative embodiment, the soft-surface rolls 70 may be omitted so that the panels are directed from the roller 45 directly onto the conveyor belt 39.

Figure 18:
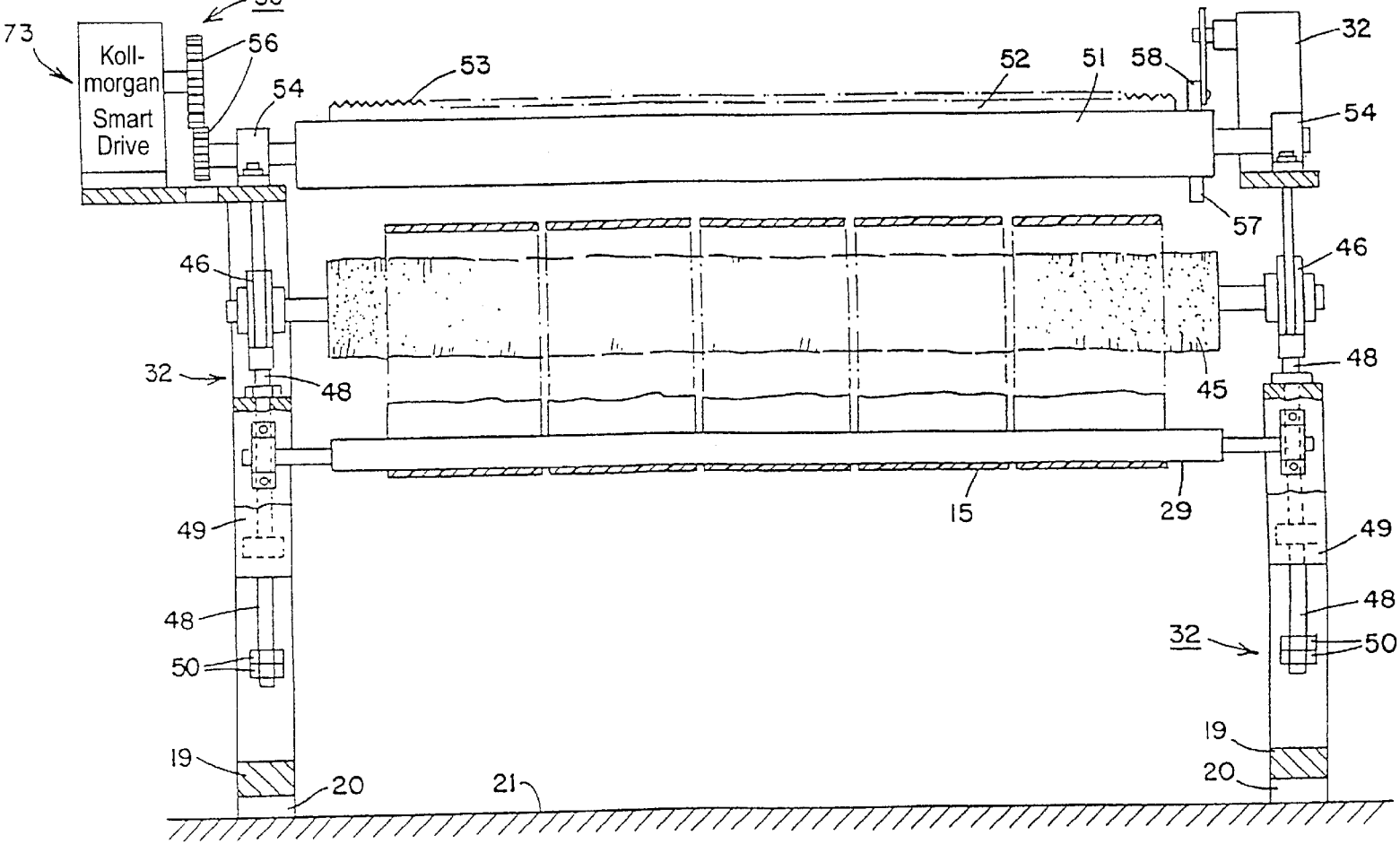
FIG. 18 illustrates a view similar to FIG. 2 of a machine employing an electronic drive to drive the perforator roll in accordance with the invention.

Referring to FIG. 18 wherein like reference characters indicate like parts as above, the perforator roll 51 is driven from a transmission 73 which is of an electronic type. For example, the transmission is a KOLLMORGEN Smart Drive including a brushless servomotor with a C-face encoder with a power supply and amplifier. Such a unit is readily available in the marketplace and a further description is not believed to be necessary. During operation, the electronic drive serves to rotate the perforator roll 51 in the programmed manner so that the perforator roll 51 has a deceleration phase prior to perforation of the web 15 and an acceleration phase after perforation of the web 15, for example as described above.

In use, the machine 10 may be programmed at start-up to effect a perforation of the web 15 at intervals, for example, of 12 inches with the web 15 traveling at a rate of 100 feet per minute. For example, a line of perforations may be effected for each revolution of the perforator roll 51. In this respect, the perforator roll 51 would have a speed commensurate with the speed of the web 15 and would be decelerated before a perforation is made and accelerated thereafter as described above. If, during operation, the operator desires to change the spacing of the perforations, for example, to 24 inches, the programmer 60 can be rapidly programmed by pushing of the buttons P1, P2 so as to allow the brush roll 45 to drop the web 15 away from the perforator roll 51 for two revolutions of the perforator roll 51 and then back up to permit perforation.

The machine can be used to perforate a traveling web, slit a traveling web or sheet the traveling web in one or more operations. Further, two or more rolls of web material may be supplied to the machine for parallel side-by-side processing or for layered processing.

The slitters which are used in the machine may also be in the form of a trim knife with notches for perforating the web longitudinally. When such a web is wound onto a spool, an operator may remove the whole trim in one piece from each end of the wound up roll. In this way, the removed trim can be readily handled for regrinding, for example for recycling purposes. Further, there is no need to have separate suction removal systems for removing a continuous strip of trim from the traveling web as is the case with previously known machines.

The combination of variable speed and variable perforation spacing provides the machine with the potential to do any size perforating with ease and infinite length.

The invention thus provides a machine which permits faster production without any start/stop operation. Further, the machine allows adjustments in the centerline to centerline spacings of perforations in a web "on the fly", that is during operation without-need to stop the machine to make an adjustment.

Further, the machine permits a multiplicity of rolls of web to be perforated at one time.

The machine is also capable of a fast set up so that little down time is required.

The machine may also be programmed so as to effect a perforating operation in a web of material or may be programmed to effect a sheeting operation, that is, a separation of the web into a plurality of panels. In either case, the web may be slit longitudinally.

What is claimed is:

1. A perforating machine comprising a supply station for receiving a web of material;

conveying means for conveying the web of material from said supply station;

a perforating station for perforating the conveyed web, said perforating station including a base roll having a plurality of upstanding filaments for supporting the conveyed web during passage through said perforating station, means for selectively moving said base roll between a retracted position and a raised position supporting the web, and a perforator roll opposite said base roll having a perforating bar disposed axially of said base roll for imparting a plurality of parallel spaced apart lines of perforations in the web passing between said rolls with said base roll in said raised position thereof, each said line of perforations defining a line of weakening in the web for subsequent separation of the web therealong into panels; and a receiving station for receiving the perforated material from said perforating station.

2. A perforating machine as set forth in claim 1 which further includes means for rotating said base roll during conveyance of a web of material thereby.

3. A perforating machine as set forth in claim 1 which further comprises a transmission for rotating said perforator roll in a cycle having a deceleration phase prior to perforation of the web to bring the surface speeds of said bar to the speed of the web and an acceleration phase after perforation of the web.

4. A perforating machine as set forth in claim 3 wherein said transmission is an electronic servomotor.

5. A perforating machine as set forth in claim 1 which further comprises a timing means for adjustably timing actuation of said means for moving said base roll to move said base roll into said raised position.

6. A perforating machine as set forth in claim 5 wherein said timing means includes a cam mounted on said perforator roll in a position indicative of the position of said bar and for rotation with said perforator roll, a first switch mounted in a first fixed position in said perforating station for emitting a second signal during passage of said cam thereby and a programmer for receiving said signals from said switches and for actuating said means for moving said base roll in response to a predetermined sequence of said signals.

7. A perforating machine as set forth in claim 6 wherein said programmer is programmed to actuate said means for moving said base roll in response to said second signal during on revolution of said perforator roll to move said base roll into said raised position to permit peroration of the web and to move said base roll into said retracted position in response to said second signal in a following second revolution of said perforator roll.

8. A perforating machine as set forth in claim 1 wherein said means for moving said base roll includes a piston and cylinder arrangement on each end of said base roll, each arrangement having a cylinder fixedly mounted in said perforating station and a piston secured at one end to said base roll and reciprocally mounted in said cylinder.

9. A perforating machine as set forth in claim 8 wherein said piston of each arrangement passes through said cylinder with a threaded end below said cylinder and which further comprises at least one adjustably mounted nut on said threaded end to adjust the movement of said base roll from said retracted position to said raised position.

10. A perforating machine as set forth in claim 1 which further comprises at least one slitter upstream of said perforator roll for impressing a longitudinal line of weakening in the conveyed web.

11. A perforating machine as set forth in claim 1 wherein said conveying means includes a feed roller and a hold-down roller upstream of said perforator roll and defining a nip for passage of the web therebetween, said hold-down roller having an axis spaced horizontally from a vertical plane passing through an axis of said feed roller and in a direction towards said perforator roll to direct the web downwardly toward said perforator roll.

12. A perforating machine as set forth in claim 1 wherein said perforating bar has a plurality of teeth to form a line of perforations across the web passing thereby.

13. A perforating machine as set forth in claim 1 wherein said perforating station includes a guide roller between said base roll and said receiving station for guiding the perforated web therebetween, said guide roll being disposed below said base roll to maintain the web against said base roll after perforation thereof.

14. A machine comprising a base roll for selectively supporting a web of material passing thereover;

means for selectively moving said base roll between a retracted position and a raised position supporting the web;

a second roll opposite said base roll having a bar thereon for imparting at least a transversely disposed line of perforations in the web passing between said rolls; and a timing means for adjustably timing actuation of said means for moving said base roll to move said base roll into said raised position.

15. A machine as set forth in claim 14 wherein said timing means includes a cam mounted on said second roll in a position indicative of the position of said bar and for rotation with said second roll, a first switch mounted in a first fixed position for emitting a first signal during passage of said cam thereby, a second switch mounted in a second fixed position for emitting a second signal during passage of said cam thereby and a programmer for receiving said signals from said switches and for actuating said means for moving said base roll in response to a predetermined sequence of said signals.

16. A machine as set forth in claim 15 wherein said programmer is programmed to actuate said means for moving said base roll in response to said second signal during one revolution of said second roll to move said base roll into said raised position to permit perforation of the web and to move said base roll into said retracted position in response to said second signal in a following second revolution of said second roll.

17. A machine as set forth in claim 14 which further comprises at least one slitter upstream of said second roll for impressing a longitudinal line of weakening in the conveyed web.

18. A machine as set forth in claim 14 wherein said conveying means includes a feed roller and a hold-down roller upstream of said second roll and defining a nip for passage of the web therebetween, said hold-down roller having an axis spaced horizontally from a vertical plane passing through an axis of said feed roller and in a direction towards said second roll to direct the web downwardly toward said second roll.

19. A machine as set forth in claim 14 wherein said second roll has a bar thereon for completely cutting the web passing thereby into a series of sheets.

20. A machine as set forth in claim 19 which further comprises a pair of rotatably driven rolls downstream of said base roll and said second roll for passage of a series of panels cut from a web therethrough.

21. A machine as set forth in claim 20 wherein each of said pair of driven rolls has a soft deformable surface engaging a respective side of a cut panel passing therebetween.

22. A machine as set forth in claim 20 which further comprises means for driving said pair of rolls at a surface speed greater than the surface speed of said base roll to effect a spacing a between successive panels cut from a web.

23. A machine as set forth in claim 22 wherein a lower roll of said pair of rolls contacts said base roll with said base roll in said raised position thereof to clean said base roll.

24. A machine as set forth in claim 14 which further comprises conveying means for conveying the web through said rolls at a variable speed to adjust the spacing between the lines of perforations in the web.

25. A sheeting machine comprising a supply station for receiving a web of material;

conveying means for conveying the web of material from said supply station;

a second station for severing the conveyed web, said station including a base roll having a plurality of upstanding filaments for supporting the conveyed web during passage through said second station, means for selectively moving said base roll between a retracted position and a raised position supporting the web, and a roll opposite said base roll and having a bar for severing the web passing between said rolls with said base roll in said raised position thereof to form a panel; and a receiving station for receiving the panel of material from said second station.

26. A machine as set forth in claim 25 which further includes means for rotating said base roll during conveyance of a web of material thereby.

27. A machine as set forth in claim 25 which further comprises a transmission for rotating said base roll with said bar in a cycle having a deceleration phase prior to severing of the web.

28. A machine as set forth in claim 25 wherein said conveying means includes a feed roller and a hold-down roller upstream of said second station and defining a nip for passage of the web therebetween, said hold-down roller having an axis spaced horizontally from a vertical plane passing through an axis of said feed roller and in a direction towards said second station to direct the web downwardly toward said roll with said bar thereon.

29. A machine as set forth in claim 25 wherein said receiving station includes a conveyor for receiving and conveying a sequence of panels from said second station for stacking downstream thereof.

30. A machine as set forth in claim 25 wherein said second station includes a pair of rotatably driven rolls between said base roll and said receiving station for passage of a series of panels severed from the web there through into said receiving station.

31. A machine as set forth in claim 30 wherein each of said pair of driven rolls has a soft deformable surface engaging a respective side of a cut panel passing therebetween.

32. A machine as set forth in claim 30 which further comprises means for driving said pair of rotatably driven rolls at a surface speed greater than the surface speed of said base roll to effect a spacing between successive panels cut from a web.

33. A machine as set forth in claim 32 wherein a lower roll of said pair of rolls contacts said base roll with said base roll in said raised position thereof to clean said base roll.

34. A perforating machine comprising a supply station for receiving a web of material;

conveying means for conveying the web of material from said supply station;

a perforating station for perforating the conveyed web, said perforating station including a base roll for supporting the conveyed web during passage through said perforating station, means for selectively moving said base roll between a retracted position and a raised position supporting the web, and a perforator roll opposite said base roll having a perforating bar disposed axially of said base roll for imparting a plurality of parallel spaced apart lines of perforations in the web passing between said rolls with said base roll in said raised position thereof, each said line of perforations defining a line of weakening in the web for subsequent separation of the web therealong into panels;

a transmission for rotating said perforator roll in a cycle having an acceleration phase prior to perforation of the web to bring the surface speeds of said bar to the speed of the web and a deceleration phase after perforation of the web; and a receiving station for receiving the perforated material from said perforating station.

35. A perforating machine as set forth in claim 34 wherein said transmission is an electronic servomotor.

36. A perforating machine comprising a supply station for receiving a web of material;

conveying means for conveying the web of material from said supply station;

a perforating station for perforating the conveyed web, said perforating station including a base roll for supporting the conveyed web during passage through said perforating station, means for selectively moving said base roll between a retracted position and a raised position supporting the web, and a perforator roll opposite said base roll having a perforating bar disposed axially of said base roll for imparting a plurality of parallel spaced apart lines of perforations in the web passing between said rolls with said base roll in said raised position thereof, each said line of perforations defining a line of weakening in the web for subsequent separation of the web therealong into panels;

a timing means for adjustably timing actuation of said means for moving said base roll into said raised position; and a receiving station for receiving the perforated material from said perforating station.

37. A perforating machine as set forth in claim 36 wherein said timing means includes a cam mounted on said perforator roll in a position indicative of the position of said bar and for rotation with said perforator roll, a first switch mounted in a first fixed position in said perforating station for emitting a first signal during passage of said cam thereby, a second switch mounted in a second fixed position in said perforating station for emitting a second signal during passage of said cam thereby and a programmer for receiving said signals from said switches and for actuating said means for moving said base roll in response to a predetermined sequence of said signals.

38. A perforating machine as set forth in claim 37 wherein said programmer is programmed to actuate said means for moving said base roll in response to said second signal during one revolution of said perforator roll to move said base roll into said raised position to permit perforation of the web and to move said base roll into said retracted position in response to said second signal in a following second revolution of said perforator roll.

39. A perforating machine comprising a supply station for receiving a web of material;

conveying means for conveying the web of material from said supply station;

a perforating station for perforating the conveyed web, said perforating station including a base roll for supporting the conveyed web during passage through said perforating station, means for selectively moving said base roll between a retracted position and a raised position supporting the web, and a perforator roll opposite said base roll having a perforating bar disposed axially of said base roll for imparting a plurality of parallel spaced apart lines of perforations in the web passing between said rolls with said base roll in said raised position thereof, each said line of perforations defining a line of weakening in the web for subsequent separation of the web therealong into panels;

said conveying means including a feed roller and a hold-down roller upstream of said perforator roll and defining a nip for passage of the web therebetween, said hold-down roller having an axis spaced horizontally from a vertical plane passing through an axis of said feed roller and in a direction towards said perforator roll to direct the web downwardly toward said perforator roll; and a receiving station for receiving the perforated material from said perforating station.

40. A perforating machine comprising a supply station for receiving a web of material;

conveying means for conveying the web of material from said supply station;

a perforating station for perforating the conveyed web, said perforating station including a base roll for supporting the conveyed web during passage through said perforating station, means for selectively moving said base roll between a retracted position and a raised position supporting the web, and a perforator roll opposite said base roll having a perforating bar disposed axially of said base roll for imparting a plurality of parallel spaced apart lines of perforations in the web passing between said rolls with said base roll in said raised position thereof, each said line of perforations defining a line of weakening in the web for subsequent separation of the web therealong into panels;

a guide roller between said base roll and said receiving station for guiding the perforated web therebetween, said guide roll being disposed below said base roll to maintain the web against said base roll after perforation thereof; and a receiving station for receiving the perforated material from said perforating station.

41. A sheeting machine comprising a supply station for receiving a web of material;

conveying means for conveying the web of material from said supply station;

a second station for severing the conveyed web, said station including a base roll for supporting the conveyed web during passage through said second station, means for selectively moving said base roll between a retracted position and a raised position supporting the web, and a roll opposite said base roll and having a bar for severing the web passing between said rolls with said base roll in said raised position thereof to form a panel;

a transmission for rotating said base roll with said bar in a cycle having an acceleration phase prior to severing of the web; and a receiving station for receiving the panel of material from said second station.

* * * * *

UNITED STATES PATENT AND TRADEMARK OFFICE

CERTIFICATE OF CORRECTION

PATENT NO. : 6,418,827 B1
DATED : July 16, 2002
INVENTOR(S) : Bussey, III et al.

It is certified that error appears in the above-identified patent and that said Letters Patent is hereby corrected as shown below:

Title page,
Item [*] Notice, delete "0" and insert -- 338 --.

Signed and Sealed this

Thirtieth Day of August, 2005

JON W. DUDAS
*Director of the United States Patent and Trademark Office*